US008398066B2

(12) United States Patent
Wang et al.

(10) Patent No.: US 8,398,066 B2
(45) Date of Patent: Mar. 19, 2013

(54) IMAGE FORMING APPARATUS WITH STAPLING FUNCTION

(75) Inventors: Chung-Kai Wang, Taipei (TW); Ching-Tse Wang, Taipei (TW); Ming-Han Chiu, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 205 days.

(21) Appl. No.: 12/984,418

(22) Filed: Jan. 4, 2011

(65) Prior Publication Data

US 2012/0027484 A1 Feb. 2, 2012

(30) Foreign Application Priority Data

Jul. 30, 2010 (TW) ..... 99125311 A

(51) Int. Cl.
*B65H 37/04* (2006.01)

(52) U.S. Cl. ..... 270/58.11; 270/58.08; 270/58.13; 399/410

(58) Field of Classification Search ..... 270/58.08, 270/58.11, 58.12, 58.13; 399/407, 410, 124
See application file for complete search history.

(56) References Cited

U.S. PATENT DOCUMENTS

| | | | | |
|---|---|---|---|---|
| 6,581,922 | B2 * | 6/2003 | Kuwata et al. | 270/58.11 |
| 6,722,646 | B2 * | 4/2004 | Sekiyama et al. | 270/58.09 |
| 6,886,828 | B2 * | 5/2005 | Saito | 271/225 |
| 7,172,186 | B2 * | 2/2007 | Saito et al. | 270/58.08 |
| 7,258,339 | B2 * | 8/2007 | Fukatsu et al. | 271/220 |
| 2002/0109283 | A1 * | 8/2002 | Hasegawa et al. | 270/58.08 |
| 2004/0042026 | A1 * | 3/2004 | Guillemin Franco et al. | 358/1.12 |
| 2009/0162082 | A1 * | 6/2009 | Shiraki et al. | 399/43 |
| 2012/0169005 | A1 * | 7/2012 | Borsuk et al. | 270/58.11 |

* cited by examiner

*Primary Examiner* — Patrick Mackey
(74) *Attorney, Agent, or Firm* — Kirton McConkie; Evan R. Witt

(57) ABSTRACT

An image forming apparatus with a stapling function is provided. The image forming apparatus includes a printing device and a stapling device. The printing device is used for printing images on plural papers. The printed papers are transmitted to the stapling device and stapled by the stapling device. The printing device has a printing device casing. The stapling device includes a minor casing and a main casing, which are respectively connected with a first surface and a second surface of the printing device casing. Since the stapling device is connected with two difference surfaces of the printing device casing, the overall height of the image forming apparatus is reduced.

9 Claims, 4 Drawing Sheets

IMAGE FORMING APPARATUS WITH STAPLING FUNCTION

FIELD OF THE INVENTION

The present invention relates to an image forming apparatus, and more particularly to an image forming apparatus with a stapling function.

BACKGROUND OF THE INVENTION

Printing devices are essential information apparatuses in modern offices. The common printing devices include for example copiers, printers, scanners and multifunction peripherals. Among these printing devices, printers are the most popular. Generally, after a printer is connected with a computer, the electronic file contained in the computer may be printed on a blank paper. In a case that the electronic file contains numerous data, the electronic file needs to be printed on at least two blank papers. For managing and filing the printed papers, the stack of printed papers are removed from the paper outlet tray of the printing device, and then aligned and stapled. Due to the stapling operation, these papers are combined together without being disorderly spread everywhere.

For most users, before the stapling operation is manually done, the printing operation of the printer should have been finished. Since different electronic files to be printed have different data amounts, the time periods of waiting for the implementation of the printing operation are usually different. Under this circumstance, the user usually fails to efficiently manage the printed papers. For solving this problem, an image forming apparatus with a stapling function has been disclosed.

FIG. 1 is a schematic side view illustrating an image forming apparatus with a stapling function according to the prior art. The image forming apparatus 1 comprises a printing device 11 and a stapling device 12. The stapling device 12 is disposed over the printing device 11. The printing device 11 comprises a paper feed tray 111, a printing module 112, a first transport path 113 and a first transport roller assembly 114. The stapling device 12 comprises a stapler 121, a paper handling tray 122, a second transport path 123 and a second transport roller assembly 124.

The paper feed tray 111 is used for supporting a stack of blank papers P1. A process of performing a printing operation by the printing device 11 will be illustrated as follows. Firstly, the papers P1 are successively fed from the paper feed tray 111 to the first transport path 113 by the first transport roller assembly 114. When the paper P1 is transported through the printing module 112 along the first transport path 113, the image data of the electronic file are printed on the paper P1 by the printing module 112. The printed paper P1 is moved upwardly to the second transport path 123 of the stapling device 12 by the first transport roller assembly 114. Then, the printed paper P1 within the second transport path 123 is transported to the paper handling tray 122 by the second transport roller assembly 124 of the stapling device 12. After the image data are completely printed, the printed papers P1 are stacked and aligned on the paper handling tray 122 and automatically stapled by the stapler 121.

Please refer to FIG. 1 again. An opening 116 is formed in the top surface 115 of the printing device 11 of the image forming apparatus 1. Via the opening 116, the first transport path 113 of the printing device 11 and the second transport path 123 of the stapling device 12 are in communication with each other. That is, because of the opening 115 at the top surface 115 of the printing device 11, the path of transporting the paper P1 is directly led to the stapling device 12 from bottom to top without changing the transport direction. In this situation, the overall height of the image forming apparatus 1 is very high.

For reducing the overall height of the image forming apparatus 1, another image forming apparatus with a stapling function has been disclosed. FIG. 2 is a schematic side view illustrating another image forming apparatus with a stapling function according to the prior art. The image forming apparatus 2 comprises a printing device 21 and a stapling device 22. The printing device 21 comprises a paper feed tray 211, a printing module 212, a first transport path 213 and a first transport roller assembly 214. The stapling device 22 comprises a stapler 221, a paper handling tray 222, a second transport path 223 and a second transport roller assembly 224. The stapling device 22 is disposed at a rear side of the printing device 21. In addition, an opening 215 is formed in a rear edge of the printing device 21. Via the opening 215, the first transport path 213 of the printing device 21 and the second transport path 223 of the stapling device 22 are in communication with each other. Since the stapling device 22 is disposed at a rear side of the printing device 21, the overall height of the image forming apparatus 2 is reduced. The disclosure of the image forming apparatus 2 may be illustrated with reference to US Patent Publication No. 20090162082.

The image forming apparatus of FIG. 2, however, still has some drawbacks. For example, if the printing device 21 has a failure (e.g. the occurrence of a paper jam event), the user should detach the stapling device 22 from the rear side of the printing device 21 in order to eliminate the troubleshoot the failure condition and perform the next step. Since the stapling device 22 has a weigh of about 7 to 10 kilograms, it is difficult for most users to perform the troubleshooting process.

SUMMARY OF THE INVENTION

The present invention relates to an image forming apparatus with a stapling function, and more particularly to an image forming apparatus having a reduced overall height by adjusting the position of the stapling device to change the transport path of the papers.

In accordance with an aspect of the present invention, there is provided an image forming apparatus with a stapling function. The image forming apparatus includes a printing device and a stapling device. The printing device is used for printing images on plural papers. The printing device includes a printing device casing, a paper feed tray, a first transport path, a first transport roller assembly and a printing module. The printing device casing has a first surface and a second surface. The opening is formed in a first surface of the printing device casing. The paper feed tray is used for supporting the papers. The first transport path is arranged between the paper feed tray and the opening. The first transport roller assembly is used for transporting the papers which are disposed within the first transport path. The printing module is disposed in the first transport path for printing the images on the papers. The stapling device is connected with the first surface and the second surface of the printing device casing of the printing device for receiving the papers from the opening, stapling the papers, and then outputting the papers. The stapling device includes a second transport path, a second transport roller assembly and a stapling part. The second transport path is in communication with the first transport path, and arranged between the opening and a paper ejecting tray. The second transport roller assembly is used for transporting the papers which are disposed within the second transport path. The stapling part includes the paper ejecting tray. The papers from the second transport path and supported on the paper ejecting tray are stapled by the stapling part. The first surface and the second surface of the printing device casing are non-coplanar.

In an embodiment, the printing device is a laser printing device.

In an embodiment, the printing module includes a laser scanning unit, an optical photoconductive drum, a charging roller, a developer roller, a toner adding roller, a transferring roller and a blade.

In an embodiment, the printing device is an inkjet printing device.

In an embodiment, the stapling part further includes a paper managing unit for aligning the papers which are placed on the paper ejecting tray, a clamping unit for clamping and fixing the aligned papers, and a stapling unit for stapling the aligned papers.

In an embodiment, the first surface is perpendicular to the second surface.

In an embodiment, the second transport roller assembly includes a paper pick-up roller and a transmission roller. The paper pick-up roller is arranged in the vicinity of the opening for transporting the papers from the opening to the second transport path. The transmission roller is arranged between the paper pick-up roller and the paper ejecting tray for transporting the papers through the second transport channel to the paper ejecting tray.

In an embodiment, the stapling device includes an L-shaped casing including a main casing and a minor casing. The main casing and the minor casing are respectively connected with the second surface and the first surface of the printing device casing.

In an embodiment, the transmission roller is disposed within the main casing, and the paper pick-up roller is disposed within the minor casing.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
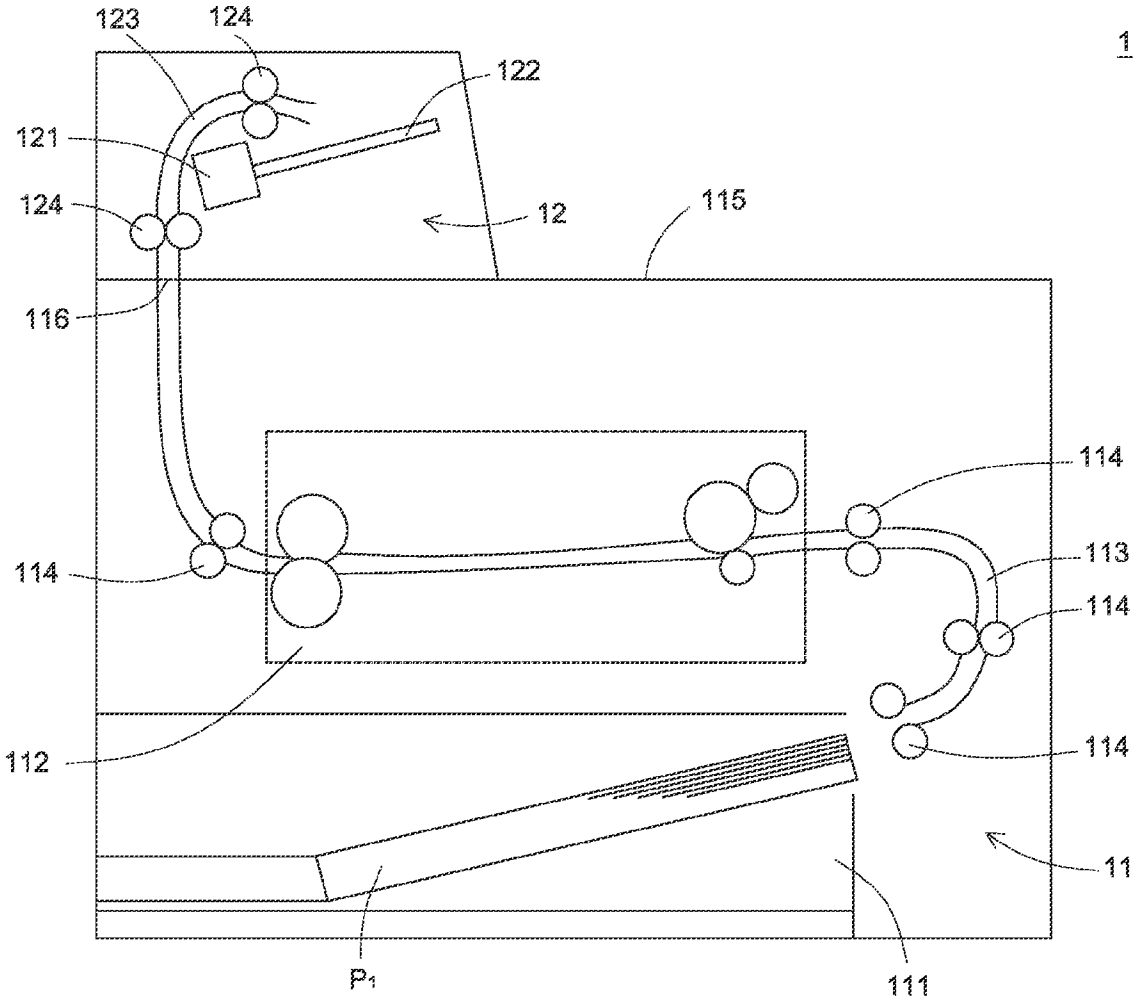
FIG. 1 (PRIOR ART)
FIG. 1 is a schematic side view illustrating an image forming apparatus with a stapling function according to the prior art.
Figure 2:
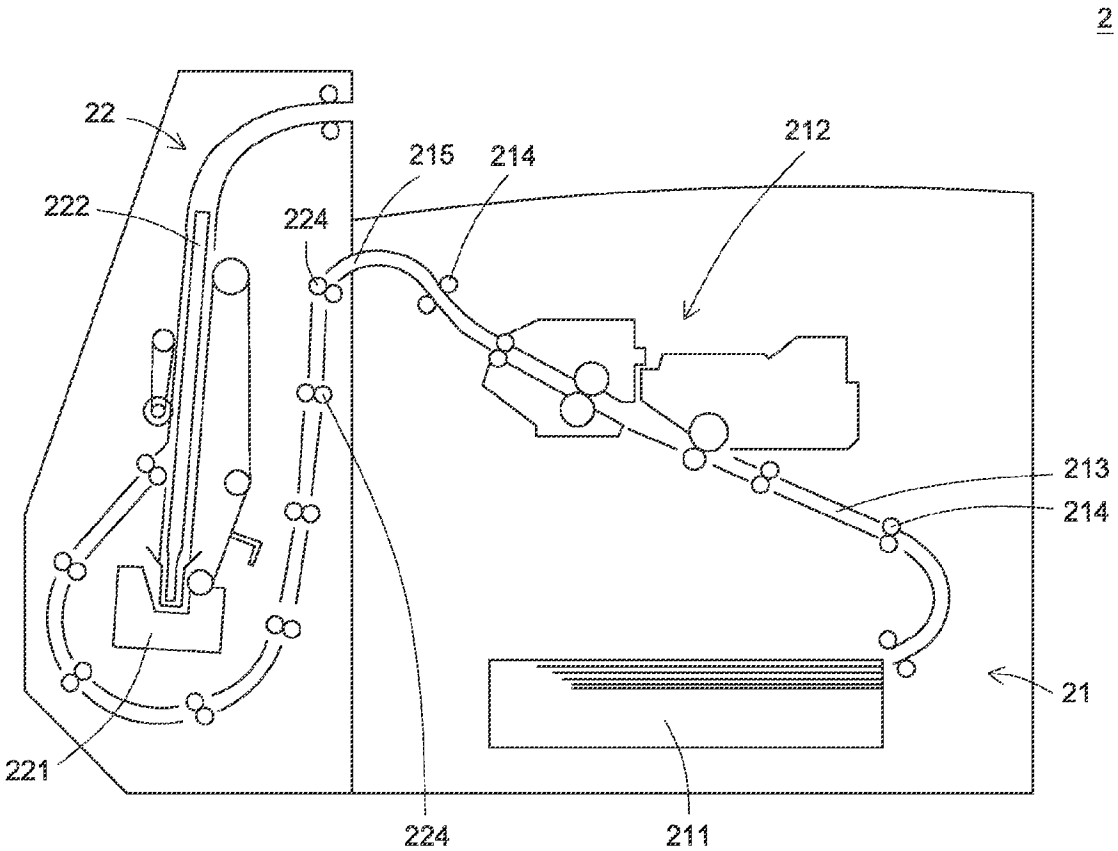
FIG. 2 (PRIOR ART)
FIG. 2 is a schematic side view illustrating another image forming apparatus with a stapling function according to the prior art.
Figure 3:
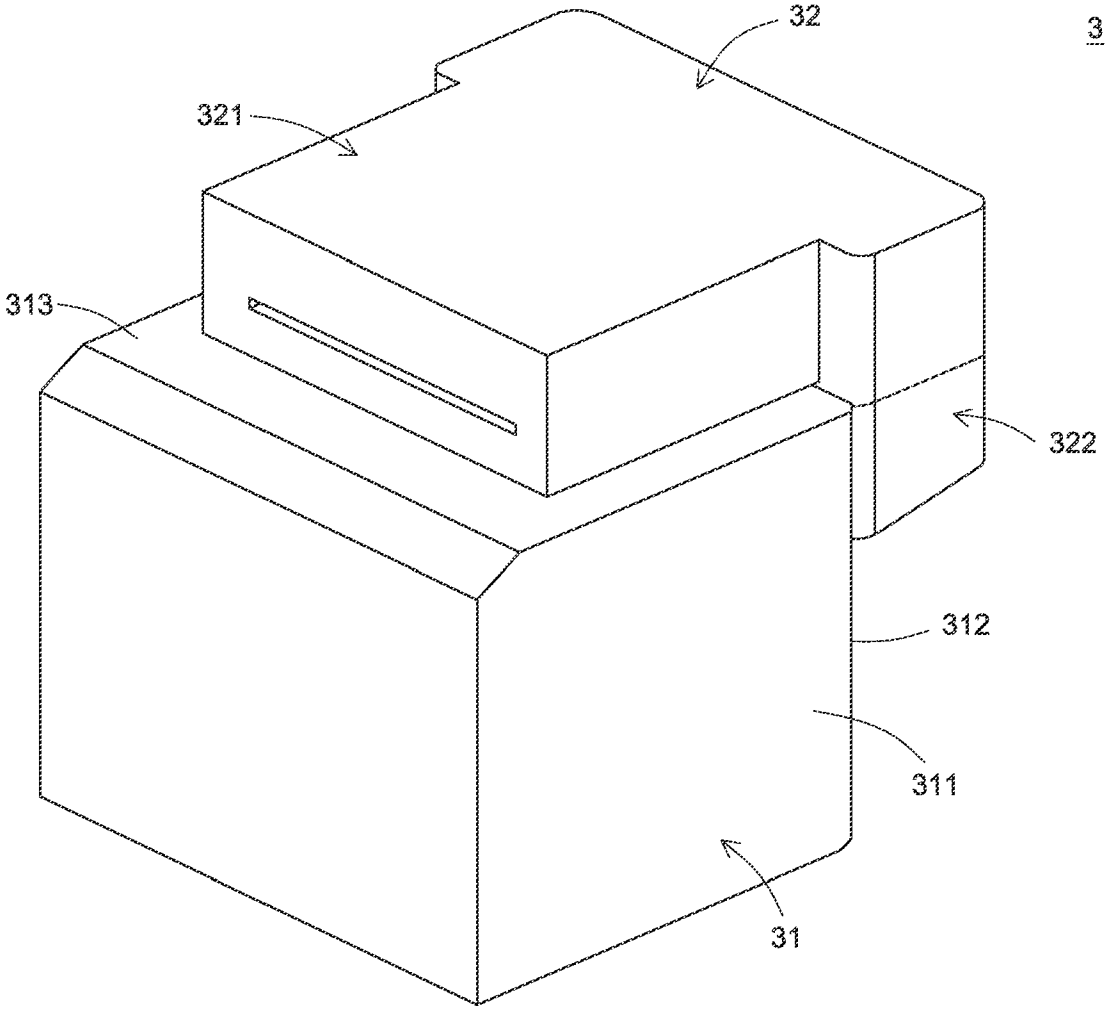
FIG. 3 is a schematic perspective view illustrating an image forming apparatus with a stapling function according to an embodiment of the present invention.
Figure 4:
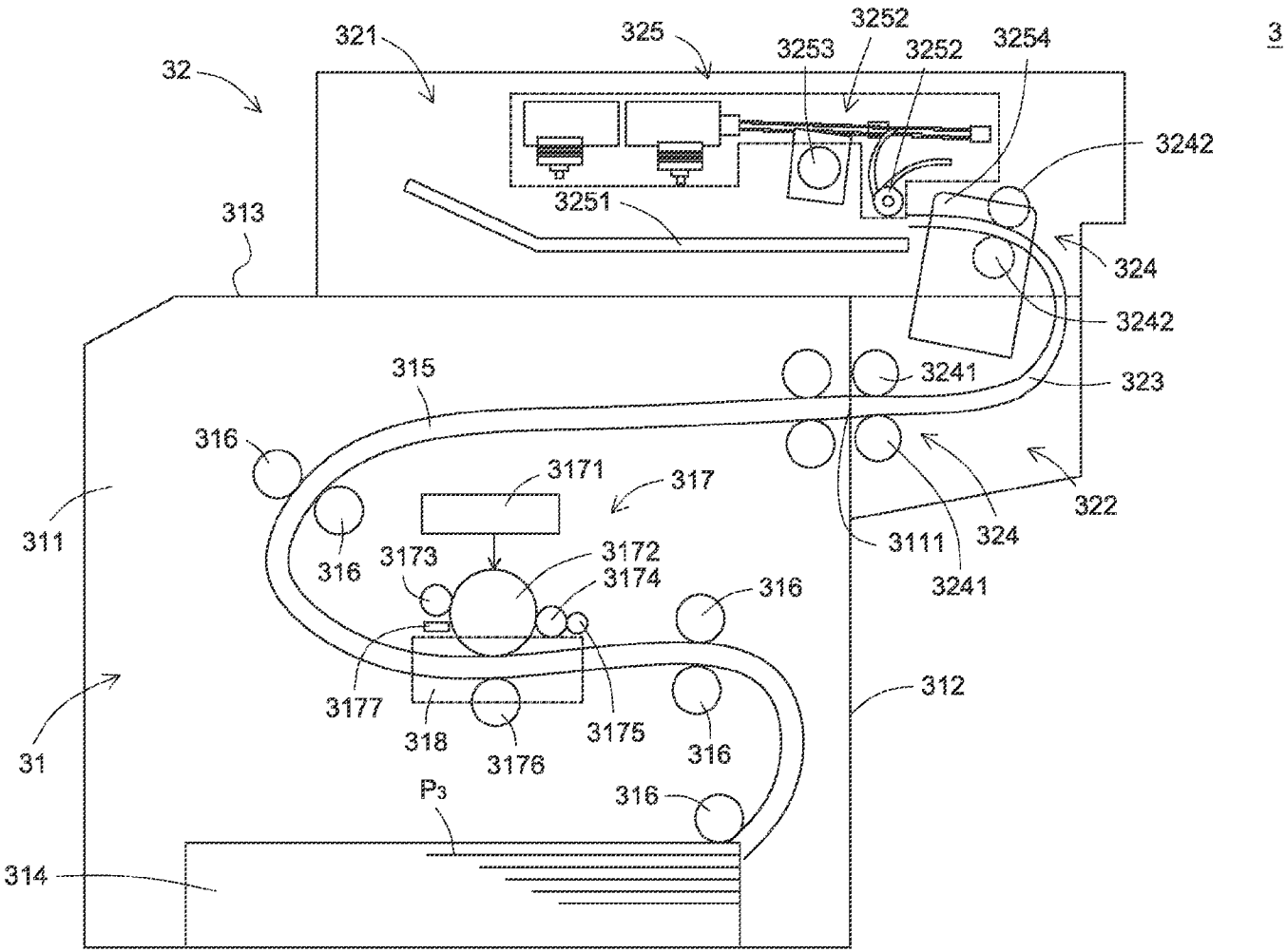
FIG. 4 is a schematic side view illustrating the image forming apparatus as shown in FIG. 3.

FIG. 3 is a schematic perspective view illustrating an image forming apparatus with a stapling function according to an embodiment of the present invention. FIG. 4 is a schematic side view illustrating the image forming apparatus as shown in FIG. 3. Please refer to FIGS. 3 and 4. The image forming apparatus 3 comprises a printing device 31 and a stapling device 32. The printing device 31 is used for printing images on plural papers. The printed papers are stapled by the stapling device 32, and then outputted from the stapling device 32. The stapling device 32 is connected with a first surface and a second surface of a printing device casing 311. In this embodiment, the first surface is a rear surface 312, and the second surface is a top surface 313. In addition, the rear surface 312 is perpendicular to the top surface 313. The stapling device 32 has an L-shaped casing includes a main casing 321 and a minor casing 322. The main casing 321 and the minor casing 322 are respectively connected with the top surface 313 and the rear surface 312 of the printing device casing 311.

For example, the printing device 31 of the image forming apparatus 3 is an inkjet printing device or a laser printing device. The printing device 31 comprises the printing device casing 311, a paper feed tray 314, a first transport path 315, a first transport roller assembly 316 and a printing module 317. In this embodiment, as shown in FIG. 3, the printing device 31 of the image forming apparatus 3 is a laser printing device. The printing module 317 of the laser printing device comprises a laser scanning unit 3171, an optical photoconductive drum 3172, a charging roller 3173, a developer roller 3174, a toner adding roller 3175, a transferring roller 3176 and a blade 3177.

The blank papers P3 to be printed are placed on the paper feed tray 314 of the printing device 31. A process of performing a printing operation by the printing device 31 will be illustrated as follows. Firstly, the papers P3 are successively fed from the paper feed tray 314 to the first transport path 315 by the first transport roller assembly 316. When the paper P3 is transported across the print region 318, the image data of the electronic file are printed on the paper P3 by the printing module 317, which is arranged in the first transport path 315. The process of printing the blank papers P3 by the printing module 317 is well known in the art, and is not redundantly described herein. In addition, the printing device casing 311 has an opening 3111. In this embodiment, the opening 3111 is arranged at the rear surface 312 of the printing device casing 311. After the printing operation is performed on the paper P3 in the print region 318, the printed paper is transported to the opening 3111 of the printing device casing 311 by the first transport roller assembly 316. Then, the printed paper P3 is ejected from the printing device 31 through the opening 3111.

The configurations of the stapling device 32 of the image forming apparatus 3 will be illustrated as follows. The stapling device 32 comprises a second transport path 323, a second transport roller assembly 324 and a stapling part 325. The second transport roller assembly 324 comprises a pick-up roller 3241 and a transmission roller 3242. The stapling part 325 comprises a paper ejecting tray 3251, a paper managing unit 3252, a clamping unit 3253 and a stapling unit 3254. The second transport path 323 is arranged between the opening 3111 of the printing device casing 311 and the paper ejecting tray 3251 of the stapling part 325.

Moreover, the minor casing 322 of the stapling device 32 is used for receiving the papers P3 from the printing device 31. The pick-up roller 3241 is disposed within the minor casing 322 and arranged in the vicinity of the opening 3111. The pick-up roller 3241 is used for transporting the papers P3 to the second transport path 323. The transmission roller 3242 is disposed within the main casing 321 and arranged over the second transport path 323. The transmission roller 3242 is used for transporting the papers P3 from the second transport path 323 to the paper ejecting tray 3251. As a consequence, the printed papers P3 are placed on the paper ejecting tray 3251.

The plural papers P3 placed on the paper ejecting tray 3251 are then managed by the paper managing unit 3252, so that the edges of all printed papers P3 are aligned with each other. The aligned papers P3 are then clamped by the clamping unit 3253, so that aligned papers P3 are fixed. Afterwards, the aligned papers P3 are stapled by the stapling unit 3254. The operating principles of the paper managing unit 3252 and the clamping unit 3253 are well known in the art, and are not redundantly described herein.

In accordance with a key feature of the present invention, the junction between the first transport path 315 of the printing device 31 and the second transport path 323 of the stapling device 32 is at the rear surface 312 of the printing device casing 311. In other words, the path of transporting the papers P3 is not directly led to the stapling device 32 from bottom to top. Whereas, the path of transporting the papers P3 is firstly led to the rear side of the printing device casing 311, and then turned around to the stapling part 325 of the stapling device 32 over the top surface 311 of the printing device casing 311. The papers P3 are stapled by the stapling part 325. In such way, the overall height of the image forming apparatus 3 is effectively reduced.

Moreover, the connecting portion between the minor casing 322 of the stapling device 32 and the rear surface 312 of the printing device casing 311 is at the upper region of the rear surface 312. This connecting portion only takes up a small area fraction of the rear surface 312 of the printing device casing 311. In a case that the printing device 31 has a failure (e.g. the occurrence of a paper jam event), the user may easily repair the inner part of the printing device 31 through the lower region of the rear surface 312 of the printing device casing 311. Since it is not necessary to detach the stapling device 32 from the printing device 31, the troubleshooting process is simplified.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An image forming apparatus with a stapling function, said image forming apparatus comprising:

a printing device for printing images on plural papers, wherein said printing device comprises:

a printing device casing having a first surface and a second surface, wherein an opening is formed in a first surface of said printing device casing;

a paper feed tray for supporting said papers;

a first transport path arranged between said paper feed tray and said opening;

a first transport roller assembly for transporting said papers which are disposed within said first transport path; and a printing module disposed in said first transport path for printing said images on said papers; and a stapling device connected with said first surface and said second surface of said printing device casing of said printing device for receiving said papers from said opening, stapling said papers, and then outputting said papers, wherein said stapling device comprises:

a second transport path in communication with said first transport path, and arranged between said opening and a paper ejecting tray;

a second transport roller assembly for transporting said papers which are disposed within said second transport path; and a stapling part comprising said paper ejecting tray, wherein said papers from said second transport path and supported on said paper ejecting tray are stapled by said stapling part, wherein said first surface and said second surface of said printing device casing are non-coplanar.

2. The image forming apparatus with a stapling function according to claim 1 wherein said printing device is a laser printing device.

3. The image forming apparatus with a stapling function according to claim 2 wherein said printing module comprises a laser scanning unit, an optical photoconductive drum, a charging roller, a developer roller, a toner adding roller, a transferring roller and a blade.

4. The image forming apparatus with a stapling function according to claim 1 wherein said printing device is an inkjet printing device.

5. The image forming apparatus with a stapling function according to claim 1 wherein said stapling part further comprises:

a paper managing unit for aligning said papers which are placed on said paper ejecting tray;

a clamping unit for clamping and fixing said aligned papers; and a stapling unit for stapling said aligned papers.

6. The image forming apparatus with a stapling function according to claim 1 wherein said first surface is perpendicular to said second surface.

7. The image forming apparatus with a stapling function according to claim 1 wherein said second transport roller assembly comprises:

a paper pick-up roller arranged in the vicinity of said opening for transporting said papers from said opening to said second transport path; and a transmission roller arranged between said paper pick-up roller and said paper ejecting tray for transporting said papers through said second transport channel to said paper ejecting tray.

8. The image forming apparatus with a stapling function according to claim 7 wherein said stapling device comprises an L-shaped casing including a main casing and a minor casing, wherein said main casing and said minor casing are respectively connected with said second surface and said first surface of said printing device casing.

9. The image forming apparatus with a stapling function according to claim 8 wherein said transmission roller is disposed within said main casing, and said paper pick-up roller is disposed within said minor casing.

* * * * *